US006398633B1

(12) United States Patent
Lothe

(10) Patent No.: US 6,398,633 B1
(45) Date of Patent: Jun. 4, 2002

(54) TWO STAGE KNIFE SHARPENER

(75) Inventor: Arlan D. Lothe, Adams, WI (US)

(73) Assignee: McGowan Manufacturing Co., Hutchinson, MN (US)

( * ) Notice: Subject to any disclaimer, the term of this patent is extended or adjusted under 35 U.S.C. 154(b) by 0 days.

(21) Appl. No.: 09/586,104

(22) Filed: Jun. 2, 2000

(51) Int. Cl.[7] ..... B24B 3/54

(52) U.S. Cl. ..... 451/545; 451/349; 451/541; 451/557; 451/558

(58) Field of Search ..... 451/349, 541, 451/545, 552, 555, 556, 557, 558; 76/86–89

(56) References Cited

U.S. PATENT DOCUMENTS

| | | | | | |
|---|---|---|---|---|---|
| 289,919 | A | | 12/1883 | Lewis | |
| 668,226 | A | * | 2/1901 | Shoemaker | 451/555 |
| 839,877 | A | | 1/1907 | Nichols | |
| 892,667 | A | | 7/1908 | Jauch | |
| 1,439,711 | A | | 1/1922 | Reder | |
| 1,426,911 | A | * | 8/1922 | Rogers | 451/545 |
| 1,474,636 | A | | 11/1923 | Judd et al. | |
| 1,561,895 | A | * | 11/1925 | Wittstein | 451/541 |
| 2,598,589 | A | | 5/1952 | Murchison | |
| 2,795,156 | A | | 6/1957 | Murchison | |
| 3,899,942 | A | * | 8/1975 | Bradbury | 451/545 |
| 4,090,418 | A | | 5/1978 | Ishida | 76/84 |
| 4,928,436 | A | * | 5/1990 | Linden | 451/541 |
| 5,163,251 | A | | 11/1992 | Lee | 51/214 |
| 5,377,563 | A | * | 1/1995 | Weeks | 451/545 |
| 5,976,002 | A | * | 11/1999 | Keough | 451/556 |
| 6,039,642 | A | * | 3/2000 | Collins | 451/557 |
| 6,071,181 | A | * | 6/2000 | Wightman et al. | 451/349 |

* cited by examiner

*Primary Examiner*—Eileen P. Morgan
(74) *Attorney, Agent, or Firm*—Westman, Champlin & Kelly, P.A.

(57) ABSTRACT

A hand held sharpener comprises a housing that has three sharpening stones having part cylindrical outer surfaces. A center stone is supported on the housing, and second and third stones are positioned on opposite sides of the center stone with axes of the peripheral surfaces of all the stones generally parallel. The stones axes lie on a plane but the spacing of the axes of a left stone is slightly different from the spacing between the axes of the center stone and the right stone, to form two different sharpening angles where the surfaces of the stones overlap. The configuration permits having a two stage sharpener with three stones that are held in a convenient housing for mounting and use. Both sides of a knife edge are sharpened simultaneously as the knife is drawn across the stones at the overlap region.

9 Claims, 3 Drawing Sheets

TWO STAGE KNIFE SHARPENER

BACKGROUND OF THE INVENTION

The present invention relates to a knife sharpener that has a plurality of at least three circular periphery stones held in a mounting block with the axes of the stones lying on a common plane so the stones are in a line. The peripheries of the outer or end stones overlap the center stone. Different spacings of the outer stone axes from the center stone axis form different sharpening angles on opposite sides of the center stone to provide one sharpening angle which is efficient for forming an edge, and another angle for polishing and refining the edge of a knife drawn across the stones.

Sharpening stones that are mounted in a housing that has separate guide surfaces on the housing for guiding a knife along or across sharpening stones at two different angles are known. One or more sharpening stones are provided on such prior art devices and are used individually. The separate guide surfaces for the side surface of a knife are positioned on the sharpener housing so that when a knife is placed on one housing guide surface and drawn across the stone, one side of the knife is sharpened at a set angle. This is repeated for forming an edge on a second side of the knife. The first sharpening is followed by drawing the knife across the same stone or a second stone while guided on a second housing surface that forms a different sharpening angle, in the prior art units.

The use of at least three stones for achieving a two stage sharpening process where both sides of the knife blade edge are engaged and sharpened or polished simultaneously is not shown.

SUMMARY OF THE INVENTION

The present invention relates to a compact knife sharpener that has at least three aligned stones that have outer surfaces parallel to parallel central axes. The stones are positioned side by side with the periphery of each outer or end stone overlapping the periphery of the center stone. The outer surfaces of each outer stone and the center stone taper relative to each other where they overlap to form a "bight" or notch across which the knife can be drawn.

The stones are preferably cylindrical and of the same diameter. The peripheries of the outer or end stones overlap the periphery of the center stone on opposite sides of the center stone. The spacing of the axis of a stone on one side of the center stone is different from the spacing of the axis of the stone on the other side of the center stone. The angle that is formed at the bight portion is thus different on one side of the center stone from the other side. The knife is sharpened on both sides of the blade in one pass of the knife as it is drawn across two of the stones in the overlapping or bight portion and then finished and polished as it is drawn across the bight portion on the other side of the center stone.

The peripheral surfaces need only be tapered or partially circular or cylindrical so that the surfaces are at the proper angle where they overlap and form the bight portion. The preferred, cylindrical peripheries form the proper angles when the radius of each stone is properly selected and the spacing of the axes is also properly selected.

The stones are mounted in a sharpener housing so that the cylindrical stones are placed with the axes of their peripheries defining a plane. The sharpener housing has a handle cross-section sized to fit into the square opening used for sharpening steels in a kitchen knife block. The sharpener housing of the present invention is elongated, and is relatively small in cross-section, but can be firmly gripped for sharpening knives.

DETAILED DESCRIPTION OF THE ILLUSTRATIVE EMBODIMENTS

Figure 1:
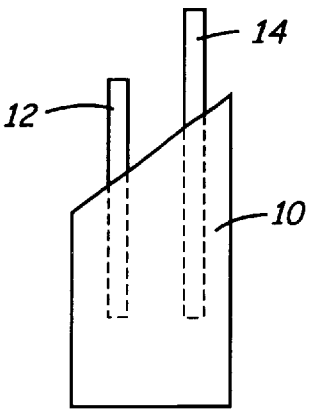
FIG. 1 is a schematic side elevational view of a typical knife storage block showing a knife sharpener made according to the present invention placed therein.

In FIG. 1, a knife storage block 10 is shown with a plurality of openings that are illustrated in dotted lines. The openings will hold knives 12 and in the block shown, a knife sharpener 14 made according to the present invention is in place. The knife sharpener 14 has a housing 16, that has a sharpening stone mounting section 18, and a handle section 20. Decorative grooves 22 can be formed along the sides of the handle, if desired.

Figure 4:
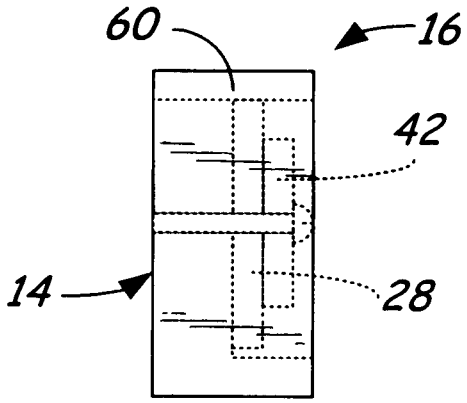
FIG. 4 is an end view of the knife sharpener of FIG. 2.

The housing 16 has a rectilinear cross-section as illustrated in FIG. 4, that is of size to fit within the normal rectangular opening in the knife block 10 that is made for a sharpening steel in the conventional knife block.

The sharpening stone mounting section 18 of the housing mounts, as shown, three sharpening stones, comprising a central stone 24, a first end stone 26, which in this form of the invention will be termed a right hand stone, and a second or left hand stone 28. The sharpening stones, as shown, have circular cylinder peripheries indicated at 26A, 24A, and 28A, respectively. The peripheries are preferably at least partially cylindrical around the stones, so that, as will be explained, the exposed portions that are used for sharpening have the circular or generally circular curve where the peripheries overlap. The peripheral surfaces can be narrow or short in axial direction, although the longer surfaces provide guidance and support for a knife.

Figure 5:
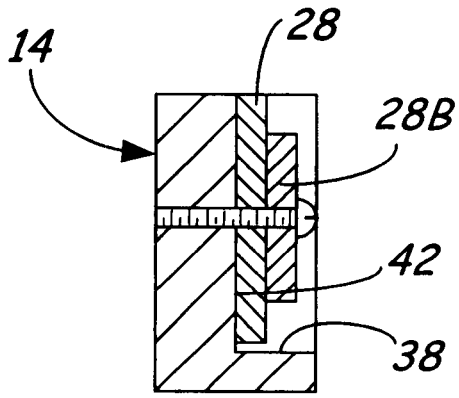
FIG. 5 is a sectional view taken as in lines 5—5 in FIG. 2.

Each of the stones has a central axis around which the circular peripheries are formed. The axes are centered on mounting screws 30, 32 and 33, respectively. The mounting screws 30, 32 and 33 thread into a backing portion of the housing, that is formed when a block is recessed along one side surface to receive the stones. There is a recess 34 for the stone 24, a recess 36 for the stone 26, and a recess 38 for the stone 28. The recesses extend only partially across the width of the block as shown typically in FIG. 5, where the recess 38 is illustrated. This leaves a backing portion 40 that provides a surface 42 for supporting each of the stones when the screws 30, 32 and 33 are tightened.

Figure 2:
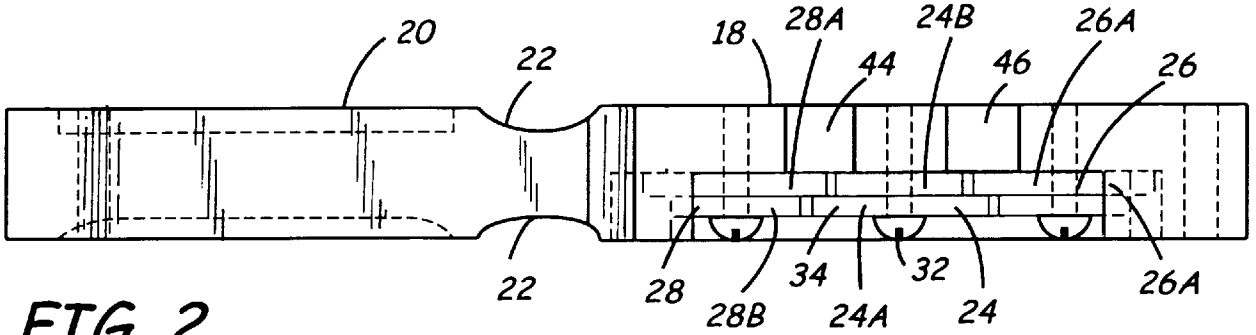
FIG. 2 is a top plan view of one embodiment of the knife sharpener of the present invention.
Figure 3:
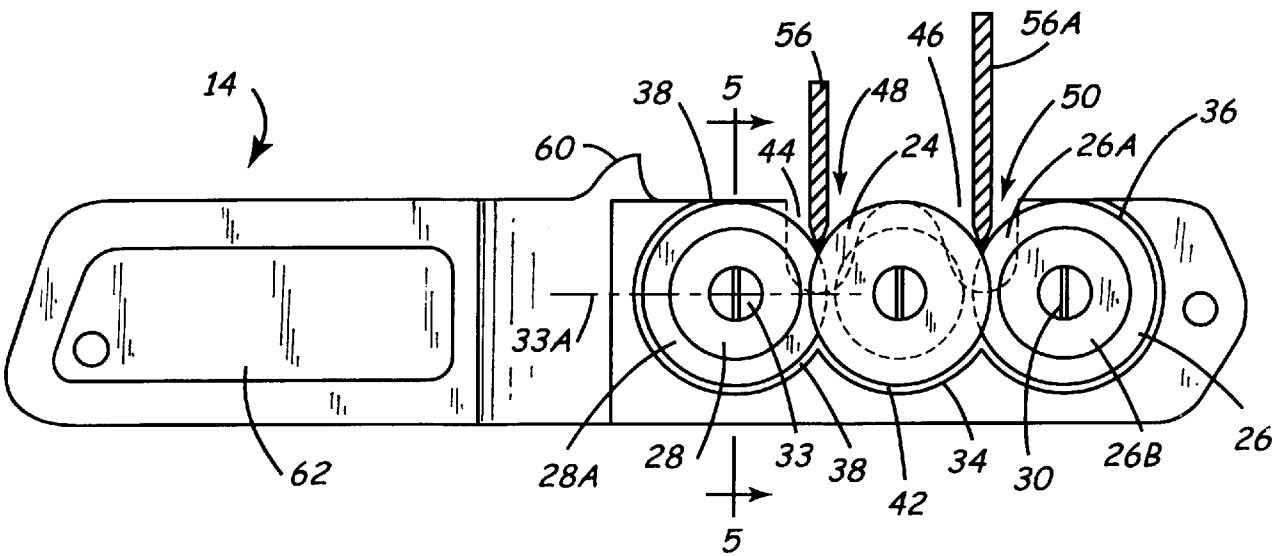
FIG. 3 is a side elevational view of the knife sharpener of FIG. 2.

The stone peripheries are made so that they overlap in side view. The axes of the screws 30 and 33, which are the axes of the circular peripheries of the outer (left and right) stones, are spaced different amounts from the axis of the center stone 24. All of the axes which are represented at the centers of the screws 30, 32 and 33 lie on a common longitudinally extending plane 33A of the housing. The backing portion 40 is provided with edge recesses 44 and 46 that align with the overlapping portion of the stones and which extend from an edge of the housing inwardly toward the centers of the stones. These recesses 44 and 46 are on the left and right hand sides of the center stone in side view. The center stone 24 is provided with a smaller diameter spacer section 24 9, which faces toward and rests against the surface 42. The outer portions of the stones 26 and 28 fit behind the main or outer section of the stone 26 where the stones overlap. This is shown in FIG. 2.

The smaller diameter spacer portions 26B and 28B of stones 26 and 28 face outwardly. The outer peripheral parts of the center stone overlap the outer peripheral portions of the outer stones when viewed along the axes of the stones. The overlapping portions of the peripheries form bight portions between adjacent stones, as illustrated at 48 and 50, respectively, on the left and right hand sides of the center stone 24.

The sharpening stones can be formed with only partial circular peripheries, or with planar peripheral surfaces, so long as the bight portions 48 and 50 are formed at the correct angle. It can be seen that the angle between the intersecting peripheries of the center stone and the left end or outer stone is different from the angle between the center stone and the right end or outer stone. This difference in angle is selected to provide for a two stage sharpening. The angles are measured in a measuring plane perpendicular to the plane defined by the axes of the stones. In other words the measuring plane for the sharpening angle is the plane of the stones.

A knife blade indicated at 56, when drawn across the bight portion 48 will be sharpened at a relatively steep angle. The knife will be drawn across the stones in a direction parallel to the axes of the stones, to form a sharpened edge on the knife. Both sides of the knife 56 blade are sharpened simultaneously. When that knife edge has been redone or sharpened, it is then finished or polished by placing it in the bight portion 50 on the right hand side of the center stone, which has a flatter angle, or larger included angle. The right side stones will form a polished or finished surface, as the knife shown at 56A is again drawn parallel to the axes of the screws 30, 32 and 33. The number of passes of the knife for proper sharpening can vary as needed for the knife blade being sharpened.

The stones are preferably made of a known ceramic material, and are molded with the offset spacer sections so that there can be peripheral portions that overlap. The side surfaces of the adjacent stones should be very closely adjacent or contiguous where they overlap. The axial thickness of the stones should be sufficient to provide a stable surface for guiding the knife edge. The recesses 44 and 46 provide clearance for the knife as can be seen in FIG. 2, so that the knife edge does not drag on the housing at the inner ends of the recesses.

The housing can be molded from a suitable plastic, or can be routed out of wood. A lug or stop 60 is preferably provided on one side of the knife sharpener housing, to engage the upper surface of the knife block 10 and prevent the sharpener housing from passing too far into the opening in the knife block.

The ends of the sharpener housing can be tapered and rounded for smooth appearance and to eliminate any sharp edges. The handle portion 20 can be recessed as at 62 to provide an area for a trademark or designs. The recessed shape can be any desired recess. If the housing is molded it would have rounded ends as shown. If it is made of wood, and routed, a router cut could have more perpendicular edges at the ends of the recess.

It should be understood that the spacers for permitting the overlap of the sharpening stones do not have to be integral with the stones. The spacers can be washers, or separate disc like stones, that would be independently formed. However, having the peripheries overlap to form a "bight" where the overlapping edges intersect in a side view, provides a self centering location for drawing a knife across the sharpening stones. Stroking the blade between the left and center stones sets a new edge or facet on the knife. The polishing and refining of the knife facet is done with a few strokes between the right and center stones.

The stones do not have to be circular periphery, but could have planar surface portions that overlap to form a bight portion, with the positioning being such that angles at the bight portions on the opposite sides of the center stone are different and are selected for proper sharpening.

Figure 6:
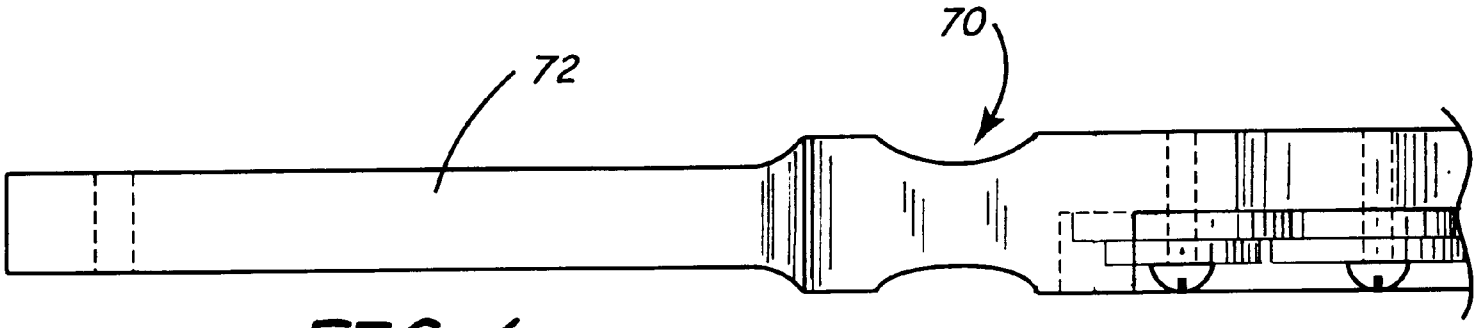
FIG. 6 is a fragmentary top plan view of a knife sharpener having a handle portion trimmed to fit a standard nominal one-half inch square sharpening steel opening in the knife block of FIG. 1.
Figure 7:
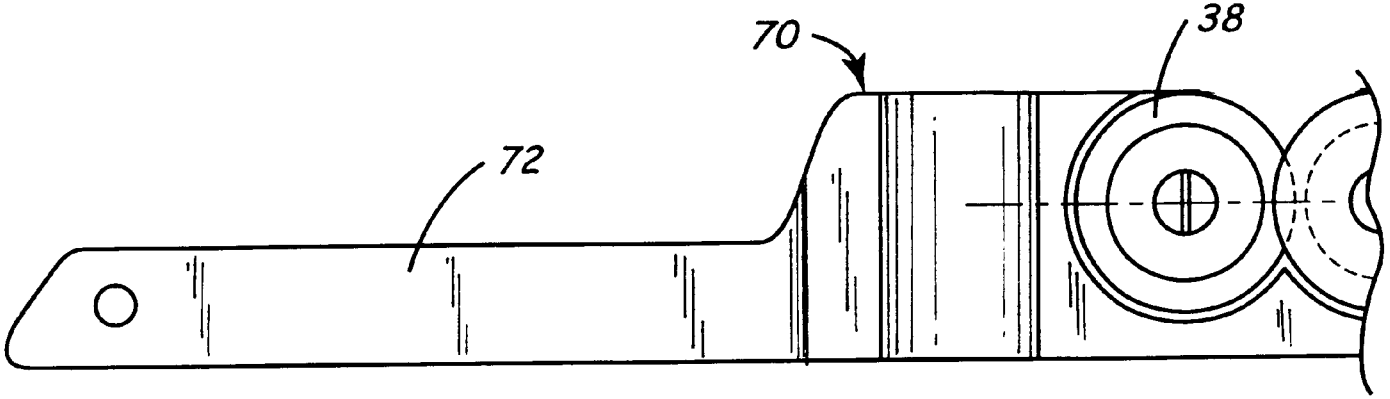
FIG. 7 is a side view of the handle of FIG. 6.

FIGS. 6 and 7 show a sharpener 70 made in the same manner as the previous embodiment, but a handle portion 72 is formed to be of size to fit into an existing nominal one-half inch square opening for a sharpening stone.

The handle portion 72 is reduced in cross sectional size from the main body and will slide into the existing steel openings on a knife block.

The hand grip area thus can be made small enough to fit into a standard knife block, while a custom knife block can be used for a thicker and larger sharpener handle as shown in FIGS. 2–5.

The knife sharpener of the present invention is much easier to use than the ordinary steel which requires quite pronounced motions of the knife as it is slid along the steel. The present sharpener can be used with a gentle stroking motion for the sharpening action, as well as the finishing action.

Although the present invention has been described with reference to preferred embodiments, workers skilled in the art will recognize that changes may be made in form and detail without departing from the spirit and scope of the invention.

What is claimed is:

1. A hand held sharpener for sharpening the cutting edge of a blade of a cutting tool comprising a housing, the housing having a mounting surface, a sharpener having a plurality of three stones mounted against said mounting surface to form the sharpener, comprising a center stone, a left stone and a right stone, the center stone being supported on the surface and having a first central axis generally perpendicular to the surface, the center stone having a peripheral edge surface portion that is parallel to the first axis, the left and right stones having second and third central axes, respectively, parallel to and lying on a common plane with the first axis, and having peripheral surfaces formed parallel to the respective central axis, a first spacing between the first axis and the second axis being different from a second spacing between the first axis and the third axis, whereby the peripheral surfaces of the center stone and the respective left and right stones taper together to form two bight portions forming two different sharpening angles when viewed in a reference plane perpendicular to the first axis.

2. The hand held sharpener of claim 1, wherein said housing includes a handle portion, and at least sections of said handle having a reduced cross section from the rest of the housing.

3. The hand held knife sharpener of claim 1, wherein said mounting surface is formed by a recess in one side surface of the housing, said recess having part cylindrical surfaces at opposite ends to receive part cylindrical surfaces of the left and right stones.

4. The hand held sharpener of claim 1, wherein the stones have side surfaces perpendicular to the respective first, second and third axes and are supported relative to the mounting surface such that the overlap portions are formed by spacing a main portion of the center stone from the surface, and first side surfaces of both the left and right stones being positioned against the mounting surface and between the mounting surface and the center stone.

5. The hand held sharpener of claim 1, wherein a spacer is positioned between a main portion of said center stone and the mounting surface to position a main portion of the center stone from the mounting surface with the right and left stones being positioned against the mounting surface and overlapping the center stone on opposite sides thereof.

6. The hand held sharpener of claim 1, wherein said housing is a molded plastic.

7. The hand held housing of claim 1, wherein said housing is formed of wood.

8. A hand held sharpener comprising an elongated housing having a handle portion and a stone mounting portion:

three stones mounted on said stone mounting portion, said stones having cylindrical outer peripheral surface portions of the same radius from central axis of the stones;

the stones being mounted on the housing with their axes generally parallel and spaced apart such that the peripheries of the stones overlap on right and left sides of a center stone to form an angle at each bight portion formed by intersections of the overlapping peripheries in a view parallel to the axes of the stones, the axes of the stones lying in a common plane, a first spacing between the axis of a left stone and the center stone being at a first distance, the peripheral surfaces of the left stone and the center stone thereby form a first angle at a first bight portion and a second spacing between the axis of a right stone and the axis of the center stone being different from the first spacing so the surfaces of the right stone and the center stone forming a second different sharpening angle at a second bight portion.

9. The hand held sharpener of claim 8, wherein the center stone has a side surface spaced from a mounting surface of the stone mounting portion and the left and right stones being supported in a space between the center stone and the mounting surface.

* * * * *